US006059249A

United States Patent [19]

Scatterday

[11] Patent Number: 6,059,249

[45] Date of Patent: May 9, 2000

[54] DEVICE FOR HOLDING PAGES

[76] Inventor: Mark A. Scatterday, 11607 E. Estrella Ave., Scottsdale, Ariz. 85259-5009

[21] Appl. No.: 09/088,591

[22] Filed: Jun. 2, 1998

[51] Int. Cl.[7] ..... A47B 97/04; A47F 1/14

[52] U.S. Cl. ..... 248/450; 248/473

[58] Field of Search ..... 248/441.1, 473, 248/469, 450; 40/649, 650, 738, 761

[56] References Cited

U.S. PATENT DOCUMENTS

| | | | |
|---|---|---|---|
| 1,681,586 | 8/1928 | Kessler | 248/473 |
| 2,729,452 | 1/1956 | Baumann | 273/150 |
| 3,779,504 | 12/1973 | Schwartz et al. | 248/441.1 |
| 5,775,663 | 7/1998 | Fitzsimmons et al. | 248/450 |
| 5,857,654 | 1/1999 | Berman | 248/441.1 |

*Primary Examiner*—Anita M. King
*Assistant Examiner*—David Heisey
*Attorney, Agent, or Firm*—Knobbe, Martens, Olson & Bear, LLP

[57] ABSTRACT

A system for holding pages comprising a plastic hollow housing partially filled with ballast and having a flat base, and a groove in the housing for holding pages. The groove has a center and outer regions and a horizontal cross section in a shallow "V" shape. The groove wall spacing is approximately constant throughout, and protrusions extending from the inner surface of a first lip near the center region of the groove and from the other wall of the groove near the outer regions of the groove create substantial friction and gripping ability.

4 Claims, 2 Drawing Sheets

DEVICE FOR HOLDING PAGES

BACKGROUND OF THE INVENTION

This invention relates to a small device to set on a desk to engage the lower edge of a sheet of paper and hold it in an upright position.

A page holder currently in use includes a housing with an upwardly opening groove or slot for holding erect one or more sheets of paper. The groove has a curved, horizontal cross section. Thus, when the lower edge of a sheet of paper is inserted in the bottom of the groove, the lower portion of the paper generally conforms to the curved shape of the groove to hold the sheets in an erect but slightly angled position for convenient viewing. It has been found, however, that a sheet is able to slide or tilt in the groove too readily, particularly if it is not carefully centered or uniformly placed in contact with the bottom of the groove. It may also move if the sheet or desk upon which the holder is resting is accidentally bumped. The shape of the groove does not seem to adequately maintain the sheet in the desired position.

Also, a front lip on this prior art device is of relatively limited height so as to create a substantial gap from one wall of the groove at the top of the lip to the other wall, which is the highest point of the groove on the device. Consequently, pages placed in the groove are somewhat unstable and the upper portion of the page can fall forward too readily.

Accordingly, an improvement is desirable for holding pages that substantially increases the friction between the pages and the walls of the groove on which it rests, and that simplifies the positioning. It is a goal that this should result in increased stability and a reduced tendency for the pages to tilt or slide within the groove or fall forward over the front lip.

SUMMARY OF THE INVENTION

One embodiment of the present invention uses a groove with a cross-sectional shape formed by two lines intersecting in a wide angled V-shape. The abruptness at the intersection of the two lines creates greater friction and gripping of the page. The approximately V-shape is an unnatural position for an unfolded page to conform and a groove in such shape successfully forces the pages against the appropriate walls of the groove.

Also, protrusions are preferably formed in the lower portion of the groove to further enhance the gripping of a sheet by the page holder. One protrusion extends into the groove from the inner surface of a forward lip near the center region of the groove. Additional protrusions extend into the groove from the opposite wall of the groove and near the outer regions of the groove. These protrusions decrease the groove width and force the lower edge of the paper in a manner to increase the gripping capability of the page holder.

The bottom wall of the groove is generally flat except for a projection on each end. Consequently, the paper is supported on these two projections, rather than trying to have the entire edge within the groove contacting the bottom wall. This is important because the groove is angled rearwardly from the bottom to the top, and hence the center section of the lower edge of the sheet is lower than the ends.

DETAILED DESCRIPTION OF THE PREFERRED EMBODIMENT

Figure 1:
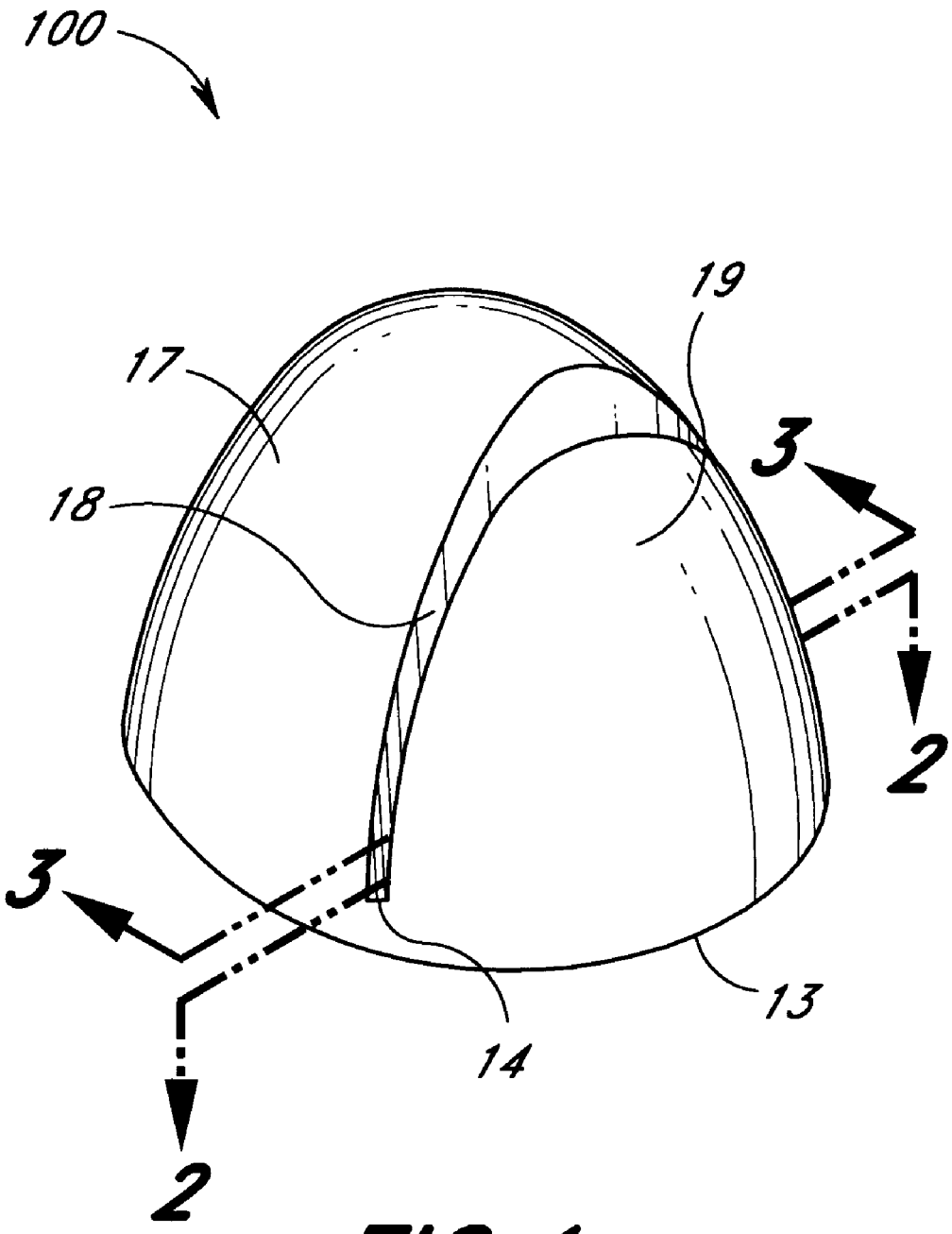
FIG. 1 is a perspective view of the page holder of the present invention.

Referring to the drawings, the holder of the present invention includes a housing 10 having approximately a truncated egg or oval shape. That is, the upper portion is about like a half an egg while it has a flat base 13. However, many other shapes and configurations are appropriate for purposes of the present invention. The housing 10 may be hollow, with a removable bottom wall for inserting a suitable ballast to provide the holder a low center of gravity for stability purposes. Alternatively, the housing can be solid, and it can be made of various materials such as metal, glass, ceramics, or combinations thereof, sized to provide stability.

As seen from the drawings, a groove 18 is formed in the housing 10, creating a forward portion or lip 19 and a larger rear or main portion 17. The groove is open upwardly and extends from near the top of the housing downwardly, terminating slightly above the base 13. The groove 18 is thus formed between the rear larger portion 17 of the housing and the lip 19. An inner surface 21 of the lip forms one wall of the groove while the inner surface 16 of the portion 17 forms the other wall of the groove.

The gap between the groove wall is relatively constant but increases slightly from bottom to top for molding purposes. It is sized to receive one or a small number of pages. The groove is approximately in the shape of two intersecting lines creating an approximately V-shape, forming an obtuse angle of about 120°. The V-shape opens towards the lip 19 such that the groove surface 21 can be thought of as a convex wall and the surface 17 forms a concave wall, although the walls are generally planar rather than curved. The V shape causes a more abrupt directional change in the center of a page 22 positioned therein than does a curve so as to cause substantial friction and enhanced gripping capability.

Figure 3:
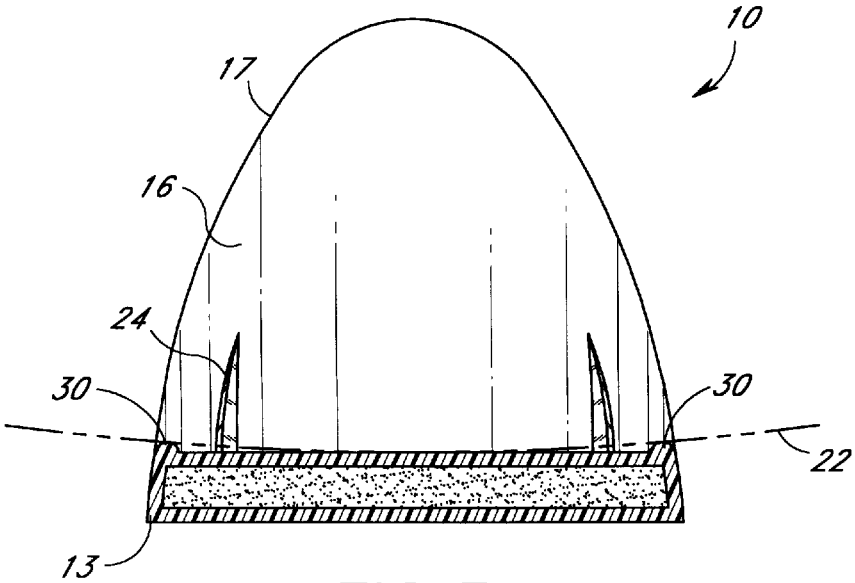
FIG. 3 is a cross-sectional view on line 3—3 of FIG. 1 through the groove.

Although the lower portion of the page 22 conforms to that shape, the upper portion tends to flatten somewhat into its normal configuration, and thus is easily viewed by the person using the page holder, such as a typist. Further, the groove is angled rearwardly from bottom to top so that the sheet is conveniently viewed, with the viewer's eye being a little higher than the page. As seen from FIG. 3, the groove bottom wall 14 is flat except that there is a short upwardly extending projection 30 on each end. The projections create a two-point support for the paper 22. Because the paper 22 is bent in the groove and the groove is slanted rearwardly from the bottom to top, the center of the paper lower edge is lower than the side lower edges. Thus, the two-point support provides stability. By contrast, a flat, bottom wall would cause the paper to contact at the center but not at the side edges of the groove. Or, if contact is made at one side edge, the paper would be spaced slightly from the other edge, and thus less stable.

To further enhance the gripping capability of the groove, there are provided protrusions 23 and 24 extending into the groove adjacent the flat bottom wall 14 of the groove. A central protrusion 23 extends into the groove from the inner surface 21 of the lip 19 near the center region 25. Two other protrusions 24 extend into the groove from the inner surface 6 of the housing portion 17 near the outer regions 26 of the groove. In the arrangement shown, the central protrusion has a curved exterior while the outer protrusions have an angled profile. The protrusions are preferably formed as an integral part of the molded housing 10.

Figure 2:
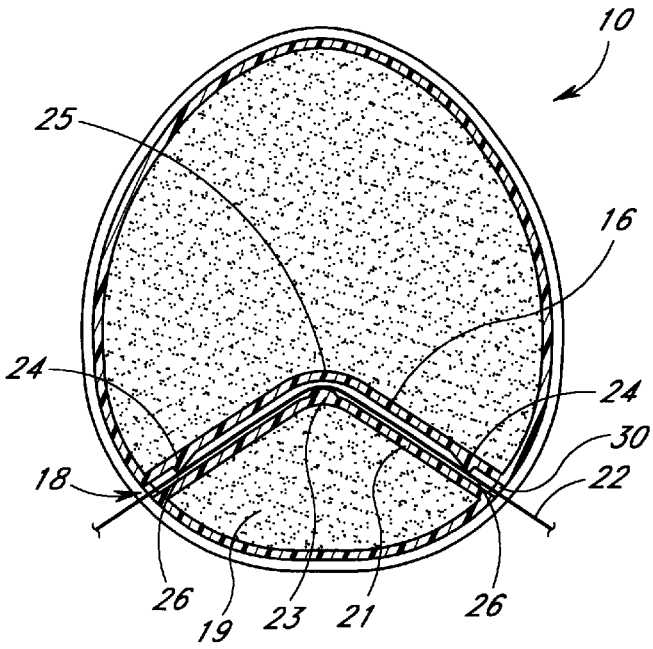
FIG. 2 is a cross-sectional view on line 2—2 of FIG. 1, with a sheet of paper schematically illustrated in the holder.

As seen from FIG. 2, the protrusions decrease the gap between the opposing walls of the groove and thereby provide increased friction between the page and the groove surfaces. Further, the sheet engages the three protrusions, thus increasing the bending and helping to keep the pages from sliding within the groove.

It may also be seen from FIG. 1 that the upper edge of the forward lip is only slightly below the upper edge of the rear portion 17. These edges help prevent a page from tipping forwardly or rearwardly.

The present invention may be embodied in other specific forms without departing from its spirit or essential characteristics. The scope of the invention is therefore indicated by the appended claims rather than the foregoing description.

What is claimed is:

1. A device for holding a page upright, the device comprising:

a base forming a substantially vertically facing bottom wall;

a forward lip portion having a convex wall extending up from the base at an acute angle relative to vertical;

a rear portion having a concave wall extending up from the base and facing the convex wall, wherein the convex wall, the concave wall and the bottom wall form a groove;

two projections extending upward from the surface of the bottom wall, one projection positioned proximate each end of the bottom wall within the groove, the projections configured to support the page substantially off of the bottom wall; and two tapered protrusions, each protrusion extending from the bottom wall upward along substantially less than the full height of one of the concave wall and the convex wall, each protrusion extending across a majority of the groove adjacent the bottom wall and tapering, as it extends upward, into the wall along which it extends.

2. The device of claim 1, wherein each tapered protrusion in conjunction with a facing wall forms a wedge configured to grip a page.

3. The device of claim 2, wherein the convex wall and the concave wall are substantially equidistant from one another within any horizontal cross section through the walls.

4. The device of claim 3, wherein said portions are substantially hollow and filled with ballast.

* * * * *